United States Patent [19]

Black et al.

[11] 3,947,160

[45] Mar. 30, 1976

[54] HOUSING AND SHAFT ARRANGEMENT

[75] Inventors: Arthur L. Black, Corning; Thomas C. Riggs, Painted Post, both of N.Y.

[73] Assignee: Ingersoll-Rand Company, Woodcliff Lake, N.J.

[22] Filed: Nov. 21, 1974

[21] Appl. No.: 526,002

[52] U.S. Cl. ..... 418/60; 308/23

[51] Int. Cl.[2] ..... F01C 21/02; F16C 35/00

[58] Field of Search ..... 418/60, 212; 123/8.07; 308/23

[56] References Cited

UNITED STATES PATENTS

| | | | |
|---|---|---|---|
| 1,271,377 | 7/1918 | Shiner | 418/60 |
| 2,117,662 | 5/1938 | Heinze | 418/60 X |
| 3,062,435 | 11/1962 | Bentele | 418/60 |
| 3,149,778 | 9/1964 | Enemark | 417/415 |
| 3,259,115 | 7/1966 | Bensinger et al. | 418/60 X |
| 3,279,279 | 10/1966 | Takebayashi | 123/8.07 X |
| 3,791,235 | 2/1974 | Woodier et al. | 418/60 X |

FOREIGN PATENTS OR APPLICATIONS

| | | | |
|---|---|---|---|
| 1,186,460 | 4/1970 | United Kingdom | 123/8.07 |

*Primary Examiner*—William L. Freeh
*Assistant Examiner*—Leonard Smith
*Attorney, Agent, or Firm*—Bernard J. Murphy

[57] ABSTRACT

The arrangement comprises an intermediate housing for a plural-rotor mainshaft of a rotary engine in which the housing is vertically split transverse to the shaft rotary axis, into two portions. Each housing portion, like the mainshaft itself, is of one-piece construction, the portions having interfaced circular bores in which to receive the mainshaft. Rotor journals integral with the mainshaft are eccentric for use with rotary pistons, and are dimensioned to fit through the bores. In addition, a large radial bearing journal, also integral with the shaft, carries a full sleeve-type bearing and is directly received by the bore formed in one housing portion; the journal and its bearing are directly supported by and wholly radially enclosed by only the one housing portion. Accordingly, none of the bearing support is overhung, and yet both housing portions are abutted and interfitted together to transmit loading therebetween.

12 Claims, 3 Drawing Figures

HOUSING AND SHAFT ARRANGEMENT

Figure 1:
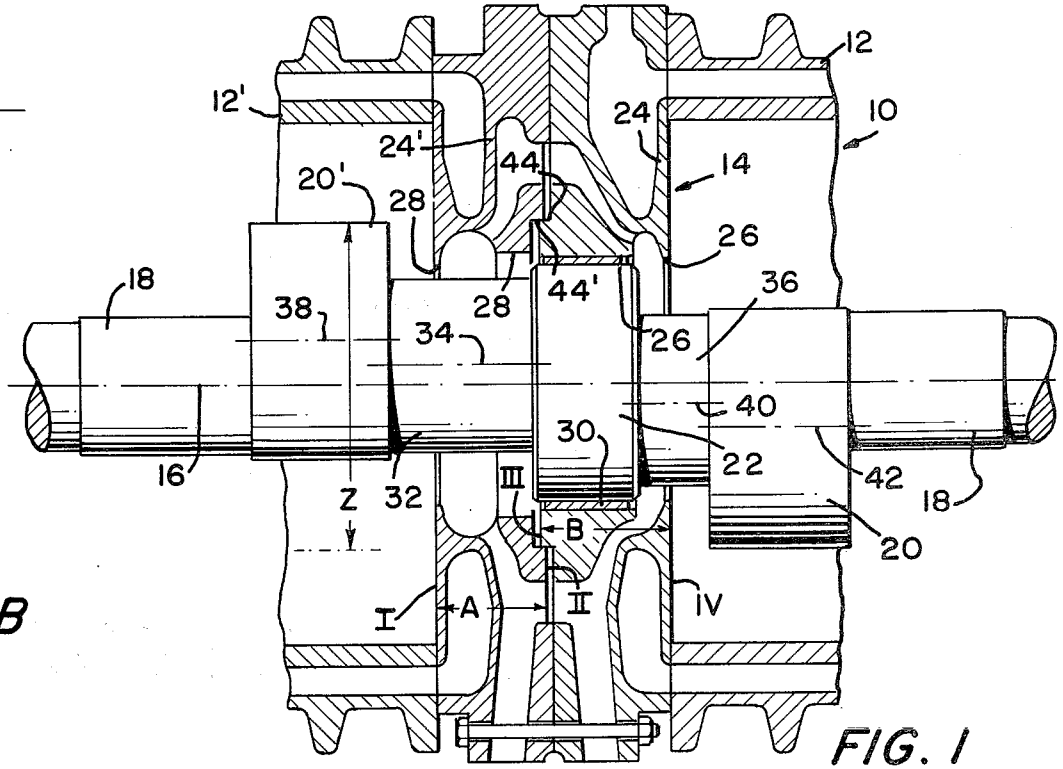

This invention pertains to housing and shaft arrangements for rotary mechanisms and in particular to such arrangements in which the housing, which supports the mainshaft of a plural rotor mechanism, is vertically split, transverse to the rotary axis of the mainshaft. U.S. Pat. No. 3,062,435 issued to Max Bentele on Nov. 6, 1962, for a Multi-Unit Rotary Engine, disclosed the particular benefit and utility to be found in the employment of vertically-split intermediate housings for rotary machines. Such housings particularly facilitate assembly, disassembly and maintenance, and enable a rather compact construction of such machines.

The instant invention was conceived during a development program having as its end purpose the construction of an especially large rotary machine which, accordingly, presented uncommon loading, and stress problems. In a large machine of the type contemplated by the invention, it is essential to have a large mainshaft bearing for support and yet it remains desirable to have an intermediate housing of sufficient axial length which will provide adequate bearing and mainshaft support, but not undue axial length. Too, it still remains desirable to have the housing split, to accommodate assembly and disassembly and servicing.

In the prior art, however, as exemplified by the cited patent, it has been the practice to employ split bearings and a vertically divided housing comprised by a plurality of diverse components. In the cited Bentele patent is disclosed an intermediate housing arrangement having one-piece housing elements, but wherein one of the housing elements has as an adjunct thereto a kind of subassembly defined by a flange extending radially from a bearing. In machines of this type, it is necessary, therefore, to make and arrange for precise alignment of the split, half-shell portions of the bearing and the fastening or clamping means therefor and also arrange for precise mating of the bearing flange to a housing portion, drilling and tapping of bolt holes, and alignment as well of an annular retainer or shield which encloses the bearing flange and is fitted into an annular recess provided therefor in the housing portion. This involves considerable time and expense in machining, but it appeared to be unavoidable if mainshaft eccentric rotor journals were to be slidably installed into and accommodated by the housing.

For large rotary machines, it is preferred to have direct rather than overhung bearing support — to avoid sheer stresses which arise in the prior art practices of housing and shaft arrangements. It is preferred to have rotor and bearing journals integral with the mainshaft, to have whole sleeve-type bearings mounted directly in intermediate housings, large shaft sections for added strength and yet, to have vertically split, one-piece housing portions. All the foregoing is to be preferred in an arrangement which, even so, will accommodate facile disassembly, assembly and servicing.

It is an object of this invention, then, to disclose such a preferred housing and shaft arrangement.

Particularly, it is an object of this invention to set forth a housing and shaft arrangement for a rotary machine, such as rotary piston engine or the like, comprising a one-piece shaft, having a longitudinal, rotary axis; said shaft also having a plurality of eccentrically-disposed rotor journals; said shaft further having a bearing journal; and a housing supporting said shaft for rotation; wherein said housing is subdivided, transverse to said axis, defining thereof a plurality of mating and interfacing one piece housing portions; said housing portions having complementary and interfacing circular bores formed therein; said rotor journals each having a given diameter; said bores having a diameter greater than said given diameter; said bearing journal having a full sleeve type bearing fitted thereabout, said bearing having an outside diameter substantially equal to said given diameter; and said bearing journal and bearing being engageably mounted in, and being directly supported by, only a single one of said housing portions, via said bore thereof; and said bearing journal and bearing being wholly radially enclosed by said single one of said housing portions.

Another object of this invention sets forth, in combination, a shaft and bearing support housing, and a rotary shaft having an eccentric rotor journal and bearing journal integral therewith, wherein said shaft is of one-piece construction and has a given nominal diameter; said rotor journal and said bearing journal having diameters approximately twice said given nominal diameter; said housing is of one-piece construction and has an axially-extending straight-walled bore formed therein for directly supporting said bearing journal in said bore wall; and said shaft and journals are slidably movable through said bore for disposing said bearing journal in said bore for direct, engaging support of said bearing journal by said bore wall.

A feature of this invention comprises an arrangement having an intermediate housing for a plural-rotor mainshaft of a rotary engine in which the housing is vertically split, transverse to the rotor axis, into two portions. Each housing portion, like the mainshaft itself, is of one-piece construction, the portions having interfaced circular bores in which to receive the mainshaft. Rotor journals integral with the mainshaft, are eccentric for use with rotary pistons, and are dimensioned to fit through the bores. In addition, a large radial bearing journal, also integral with the shaft, carries a full sleeve-type bearing and is directly received by the bore formed in one housing portion; the journal and its bearing are directly supported by and wholly radially enclosed by only the one housing portion. Accordingly, none of the bearing support is overhung, and yet both housing portions are abutted and interfitted together to transmit loading therebetween.

Figure 2A:
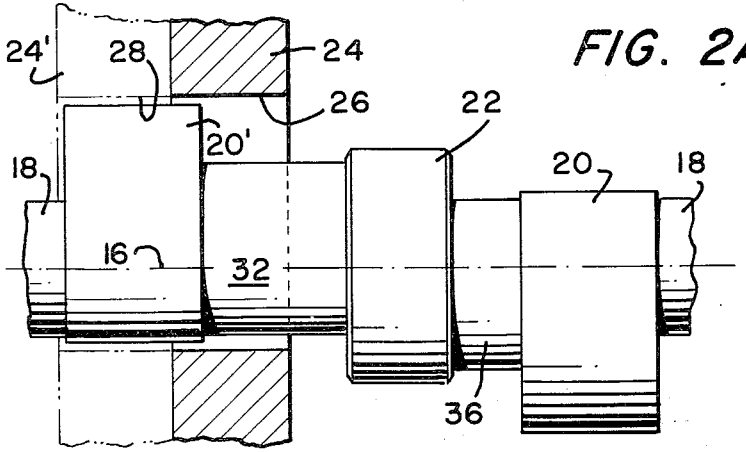
Figure 2B:
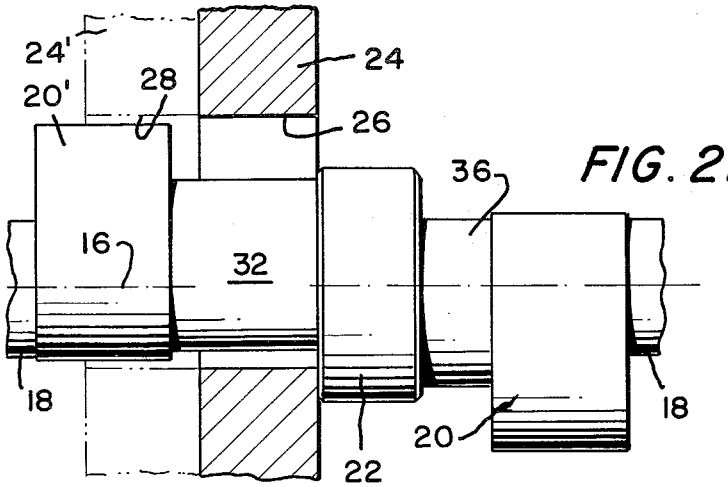

Further objects and features of this invention will become more apparent by reference to the following description taken in conjunction with the accompanying figures in which:

FIG. 1 is a vertical, cross-sectional view of an embodiment of the housing and shaft arrangement according to the invention; and FIGS. 2A and 2B are outline type diagrams depicting the installation of the mainshaft with its integral journals into the housing, an intermediate housing.

As shown in FIG. 1, a housing 10 for a rotary machine comprises a pair of rotor housings 12 and 12' which have, therebetween, an intermediate housing 14. The intermediate housing 14 is split vertically, transverse to the axis 16 of a mainshaft 18. At spaced-apart locations, the mainshaft 18 carries a pair of integral rotor journals 20 and 20'. The rotor journals are those of the eccentric type, well known in the art, which are used in conjunction with rotary pistons or rotors for use in Wankel-type, epitrochoidal engines, and have therebetween an integral bearing journal 22.

The split housing 14 defines a pair of one-piece housing portions 24 and 24'. Each of the housing portions has a circular bore 26 and 28 which interfaces the bore of the other for accommodating the mainshaft 18 therewithin. The rotor journals 20 and 20' and the bearing journal 22 are of substantially common diameter, and the bearing journal 22 has a full sleeve bearing 30 fitted thereabout.

The bearing journal 22 and bearing 30 are directly received and supported by only one of the housing portions 24, this housing portion completely enclosing the bearing 30 and journal 22 thereabout.

The prior art practices employ split bearings of some relatively smaller diameter and greater axial length. However, according to our teaching, a large diameter, whole bearing 30 is used, there remaining only the difficulty of mounting the mainshaft 18 with a bearing 30 and journal 22 of such diameter in one-piece intermediate housing portions 24 and 24'.

According to our teaching, the mainshaft 18 is admitted through the right-hand portion 24 of the housing 14 until the bearing 30 and its journal 22 must be accommodated. Then, as shown in the installation progression depicted in FIGS. 2A and 2B, the mainshaft 18 must be elevated so that the intermediate bearing journal portion might be received in the one housing portion 24.

The benefit of the split housing 14 is evident now. It will be appreciated that the mainshaft 18 cannot be elevated, to admit journal 22 into bore 26, due to the interference of bore 28 with journal 16. Accordingly, housing portion 24' is removed from portion 24; the former is assembled to the latter, after the mainshaft 18 is properly fitted in place in housing portion 24.

An intermediate portion 32 of the mainshaft having an axial length equal to, and slightly greater than, the width of the housing portion 24, is provided in order that the first rotor journal 16 will clear the housing portion 24 (in order that the mainshaft might be elevated to fit the bearing journal 22). If it would be considered advantageous to have a bearing journal 22 equal in length to the width of the full intermediate housing 14, it would also be necessary to have an intermediate shaft portion 32 of twice the bearing length. This is undesirable, as it would provide a machine of undue axial length. Alternatively, then, we propose a large (radial) bearing and journal rather than a extended (axial) bearing and journal. In that both the rotor journal 16 and the bearing journal 22 can be moved through the one housing portion 24 we provide shaft portion 32 as a large, circular shaft section to enhance the strength of the mainshaft. This section portion 32, has a center line 34 which is offset relative to the mainshaft axis 16. A similar, but axially shorter, second large shaft portion 36 also contributes to the strength of the mainshaft. The center line 34 of shaft portion 32 is intermediate the axis 16 and the centerline 38 of journal 16, and the centerline 40 of shaft portion 36 is intermediate axis 16 and the centerline 42 of rotor journal 20.

Housing portions 24 and 24' have axial dimensions A and B defined by outermost planar surfaces I, II, III and IV, yet planar surfaces II and III overlap, as the portions 24 and 24' are interfitted together. Surfaces II and III are recessed to define complementary, annular shoulders 44 and 44' which close upon one another with an interferenc fit. Radially outwardly therefrom, housing portions 24 and 24' are abutted together.

Our teaching discloses the manner of solidly mounting a rather massive mainshaft and journal unit in a simplified split housing arrangement, where the unit and the housing portions are each of one-piece construction. The rotor journals 20 and 20' rotate within a rotary envelope Z which has a diameter some twenty percent greater than the smaller diameters of bores 26 and 28. The bearing 30 and its journal 22 are directly and radially supported by housing portion 24, and yet the interfitting of shoulders 44 and 44' transmit loading into housing portion 24'. The bearing journal 22 is quite large, and wholly adequate to support the mainshaft 18 and rotor journals 20, 20', and having a diameter which is more than twice the axial length thereof. Notwithstanding the large radial dimension of the bearing journal 22, it receives a whole (non-split) shell-type bearing 30. The housing and shaft arrangement still accommodates assembly, disassembly and repair with no less facility than that offered by Patentee Bentele's "Engine".

While we have described our invention in connection with a specific embodiment it is to be clearly understood that this is done only by way of example and not as a limitation to the scope of our invention set forth in the objects thereof and in the appended claims.

We claim:

1. A housing and shaft arrangement, for a rotary mechanism such as a rotary piston engine or the like, comprising:

a one-piece shaft having a longitudinal, rotary axis;

said shaft also having a plurality of eccentrically-disposed rotor journals;

said shaft further having a bearing journal; and a housing supporting said shaft for rotation; wherein said housing is subdivided, traverse to said axis, defining thereof a plurality of mating and interfacing one-piece housing portions;

said housing portions having complementary and interfacing circular bores formed therein;

said rotor journals each having a given diameter;

said bores having a diameter greater than said given diameter;

said bearing journal having a full sleeve-type bearing fitted thereabout, said bearing having an inside diameter substantially equal to said given diameter; and said bearing journal and bearing being engageably mounted in, and being directly supported by, only a single one of said housing portions, via said bore thereof; and said bearing journal and bearing being wholly radially enclosed by said single one of said housing portions.

2. A housing and shaft arrangement, for a rotary mechanism such as a rotary piston engine or the like, comprising:

a one-piece shaft having a longitudinal, rotary axis;

said shaft also having a plurality of eccentrically-disposed rotor journals;

said shaft further having a bearing journal; and a housing supporting said shaft for rotation; wherein said housing is subdivided, traverse to said axis, defining thereof a plurality of mating and interfacing one-piece housing portions;

said housing portions having complementary and interfacing circular bores formed therein;

said rotor journals each having a given diameter;

said bores having a diameter greater than said given diameter;

said bearing journal having a full sleeve-type bearing fitted thereabout, said bearing having an inside diameter substantially equal to said given diameter;

said bearing journal and bearing being engageably mounted in, and being directly supported by, only a single one of said housing portions, via said bore thereof;

said bearing journal and bearing being wholly radially enclosed by said single one of said housing portions;

said shaft has a prescribed, nominal diameter; and said bearing journal has a diameter which is substantially twice said prescribed nominal diameter.

3. A housing and shaft arrangement, for a rotary mechanism such as a rotary piston engine or the like, comprising:

a one-piece shaft having a longitudinal, rotary axis;

said shaft also having a plurality of eccentrically-disposed rotor journals;

said shaft further having a bearing journal; and a housing supporting said shaft for rotation; wherein said housing is subdivided, traverse to said axis, defining thereof a plurality of mating and interfacing one-piece housing portions;

said housing portions having complementary and interfacing circular bores formed therein;

said rotor journals each having a given diameter;

said bores having a diameter greater than said given diameter;

said bearing journal having a full sleeve-type bearing fitted thereabout, said bearing having an inside diameter substantially equal to said given diameter;

said bearing journal and bearing being engageably mounted in, and being directly supported by, only a single one of said housing portions, via said bore thereof;

said bearing journal and bearing being wholly radially enclosed by said single one of said housing portions; and said shaft further has a given axial portion which is eccentrically formed relative to said axis.

4. A housing and shaft arrangement, for a rotary mechanism such as a rotary piston engine or the like, comprising:

a one-piece shaft having a longitudinal, rotary axis;

said shaft also having a plurality of eccentrically-disposed rotor journals;

said shaft further having a bearing journal; and a housing supporting said shaft for rotation; wherein said housing is subdivided, traverse to said axis, defining thereof a plurality of mating and interfacing one-piece housing portions;

said housing portions having complementary and interfacing circular bores formed therein;

said rotor journals each having a given diameter;

said bores having a diameter greater than said given diameter;

said bearing journal having a full sleeve-type bearing fitted thereabout, said bearing having an inside diameter substantially equal to said given diameter;

said bearing journal and bearing being engageably mounted in, and being directly supported by, only a single one of said housing portions, via said bore thereof;

said bearing journal and bearing being wholly radially enclosed by said single one of said housing portions; and at least one of said rotary journals defines a rotary envelope having a diameter which is greater than said diameters of said bores.

5. A housing and shaft arrangement, for a rotary mechanism such as a rotary piston engine or the like, comprising:

a one-piece shaft having a longitudinal, rotary axis;

said shaft also having a plurality of eccentrically-disposed rotor journals;

said shaft further having a bearing journal; and a housing supporting said shaft for rotation; wherein said housing is subdivided, traverse to said axis, defining thereof a plurality of mating and interfacing one-piece housing portions;

said housing portions having complementary and interfacing circular bores formed therein;

said rotor journals each having a given diameter;

said bores having a diameter greater than said given diameter;

said bearing journal having a full sleeve-type bearing fitted thereabout, said bearing having an inside diameter substantially equal to said given diameter;

said bearing journal and bearing being engageably mounted in, and being directly supported by, only a single one of said housing portions, via said bore thereof;

said bearing journal and bearing being wholly radially enclosed by said single one of said housing portions; and at least one of said rotor journals defines an overall rotary envelope having a diameter which is substantially 20% greater than said diameters of said bores.

6. A housing and shaft arrangement, for a rotary mechanism such as a rotary piston engine or the like, comprising:

a one-piece shaft having a longitudinal, rotary axis;

said shaft also having a plurality of eccentrically-disposed rotor journals;

said shaft further having a bearing journal; and a housing supporting said shaft for rotation; wherein said housing is subdivided, traverse to said axis, defining thereof a plurality of mating and interfacing one-piece housing portions;

said housing portions having complementary and interfacing circular bores formed therein;

said rotor journals each having a given diameter;

said bores having a diameter greater than said given diameter;

said bearing journal having a full sleeve-type bearing fitted thereabout, said bearing having an inside diameter substantially equal to said given diameter;

said bearing journal and bearing being engageably mounted in, and being directly supported by, only a single one of said housing portions, via said bore thereof;

said bearing journal and bearing being wholly radially enclosed by said single one of said housing portions; and said shaft further has a plurality of given axial portions which are eccentrically formed relative to said axis.

7. An arrangement, according to claim 6, wherein:

said axial portions have disparate axial lengths.

8. A housing and shaft arrangement, for a rotary mechanism such as a rotary piston engine or the like, comprising:

a one-piece shaft having a longitudinal, rotary axis;

said shaft also having a plurality of eccentrically-disposed rotor journals;

said shaft further having a bearing journal; and a housing supporting said shaft for rotation; wherein said housing is subdivided, traverse to said axis, defining thereof a plurality of mating and interfacing one-piece housing portions;

said housing portions having complementary and interfacing circular bores formed therein;

said rotor journals each having a given diameter;

said bores having a diameter greater than said given diameter;

said bearing journal having a full sleeve-type bearing fitted thereabout, said bearing having an inside diameter substantially equal to said given diameter;

said bearing journal and bearing being engageably mounted in, and being directly supported by, only a single one of said housing portions, via said bore thereof;

said bearing journal and bearing being wholly radially enclosed by said single one of said housing portions; and an axial portion of said bearing journal and bearing are enclosed by another of said housing portions.

9. An arrangement, according to claim 8, wherein:

said one housing portion has a maximum width defined by opposite, planar surfaces thereof which lie in first and second parallel and axially spaced-apart planes;

said another of said housing portions has a maximum width defined by opposite, planar surfaces thereof which lie in third and fourth parallel and axially spaced-apart planes; and wherein said third plane is more adjacent to said first plane than is said second plane.

10. An arrangement, according to claim 9, wherein:

said one and another housing portions have complementary, annular recesses formed therein which effect an interference fit therebetween.

11. An arrangement, according to claim 10, wherein:

said annular recess of said one housing portion defines an annular shoulder which projects axially from said third plane toward said fourth plane.

12. An arrangement, according to claim 10, wherein:

said annular recess of said another housing portion defines an annular journal which is in penetration of said second plane.

* * * * *